United States Patent [19]

Tanaka et al.

[11] 4,028,517

[45] June 7, 1977

[54] MICROWAVE OVEN

[75] Inventors: Junzo Tanaka, Fujiidera; Chikao Nakano, Yamatokoriyama, both of Japan

[73] Assignee: Matsushita Electric Industrial Co., Ltd., Kadoma, Japan

[22] Filed: Feb. 28, 1975

[21] Appl. No.: 554,113

[30] Foreign Application Priority Data

Mar. 4, 1974 Japan ..... 49-25427

[52] U.S. Cl. ..... 219/10.55 B

[51] Int. Cl.[2] ..... H05B 9/06

[58] Field of Search ..... 219/10.55 B, 10.55 E

[56] References Cited

UNITED STATES PATENTS

| | | | |
|---|---|---|---|
| 3,377,564 | 4/1968 | Stella et al. | 219/10.55 B |
| 3,569,656 | 3/1971 | White et al. | 219/10.55 B |
| 3,684,978 | 8/1972 | Otaguro | 219/10.55 B |
| 3,848,105 | 11/1974 | Mori | 219/10.55 E |
| 3,862,390 | 1/1975 | Noda | 219/10.55 B |
| 3,889,091 | 6/1975 | Ishikawa | 219/10.55 B |

*Primary Examiner*—Arthur T. Grimley

*Attorney, Agent, or Firm*—Stevens, Davis, Miller & Mosher

[57] ABSTRACT

A microwave oven comprises a timer for setting a cooking time period, a cooking menu selector with a scale indicating an optimum heating time period for each type of food and quantity thereof and a high frequency output selection switch linked to the cooking menu selector or operated manually. By operating the cooking menu selector to select a corresponding scale for the food to be cooked and setting the timer to a quantity of the food marked on the selected scale, an optimum heating time period may be set, and at the same time the high frequency output selection switch is actuated in a linked relation with the cooking menu selector or manually to select a high frequency output which is optimum to the type of food to be cooked. An output indicator for indicating the selection of the high frequency output is also provided in linked relation to the high frequency output selection switch. By the use of a simple and inexpensive structure of the cooking menu selector and the high frequency output selection switch linked thereto, optimum cooking for the type of food and the quantity thereof including cooking of eggs and defrosting of frozen foods is attained in a simple operation.

6 Claims, 8 Drawing Figures

MICROWAVE OVEN

The present invention relates to a microwave oven, and more particularly to a microwave oven which allows setting of an optimum heating time period to a type of food to be cooked and a quantity thereof and switching of an optimum high frequency output in a linked relation to the selection of a cooking menu or manually.

The microwave oven generally dielectrically heats food for cooking using a high frequency wave in the order of 2450 MHz. The heating for cooking can be classified into;

a. cooking of raw foods { • foods other than eggs (such as steaks or hamburgs)
b. re-heating { • eggs
c. defrosting For the cooking of raw food other than eggs, such as steaks or hamburgs and re-heating of foods, cooking time may be shortened when a higher level of high frequency output is used and overheating within a certain limit does not cause a significant problem. For the cooking of eggs, however, if the high frequency output is of too high level, there is a large possibility of growth of blowholes in the white of the egg and bursting of the yolk of the egg, resulting in an unsightly appearance. In the case of defrosting frozen foods, because of the difference in the dielectric constant between water and ice, the water may be readily heated but the ice does not easily thaw due to its low dielectric constant, resulting in unevenness in cooking.

As an approach to overcome the above difficulties a so-called defrosting timer which is an intermittent oscillator for turning on the high frequency output for several seconds and turning off the same for subsequent several seconds has been used. It makes use of the effect of thermal conduction during the turn-off of the high frequency output to obtain uniform heating. It may, therefore, be effective in the cooking of eggs and the defrosting of frozen food.

For this reason ovens with such defrosting timers have been marketed. Those defrosting timers have employed the methods of; (a) turning on and off a primary input current to the microwave oven by a thyristor, and (b) turning on and off the primary input current to the microwave oven by making and breaking a contact of a switch by means of cam attached to a motor shaft. Both methods, however, included disadvantages in that the method (a) required a timing control circuit in addition to the thyristor, which resulted in an increase in the cost, and method (b) shortened the durability of the apparatus because an extremely large number of turn-on and turn-off operations were included. In addition, in the above microwave oven, a switch for selecting the defrosting timer must be arranged in a control panel of the microwave oven, which results in an increase of the cost and inconvenience in practical operation.

Furthermore, where the selection switch for the high frequency output is provided, an indicator therefor is naturally required on the microwave oven. Since the indicator usually consists of an indicator lamp on the control panel of the microwave oven, an additional space for the other indicator lamp is required in the control panel, which causes the space for a pack timer to be smaller, which in turn obstructs the ease of reading.

U.S. Pat. No. 2,725,029 discloses a slide rule type cooking chart for determining an optimum cooking time depending on the menu and the quantity of food. It is somewhat similar to a slide rule type cooking chart for selecting a cooking menu intended in the present invention but the former requires separate setting of heating time determined from the cooking chart by means of a timer.

U.S. Pat. No. 3,259,056 discloses an automatic oven heat control in which the heating time is automatically set by selecting a menu and measuring the weight of the food. However, it is not provided with means for selecting the high frequency output depending on the selected menu.

It is a principal object of the present invention to provide a microwave oven including means for selecting an optimum high frequency output for a selected menu, at a timer section of a cooking menu whereby optimum cooking is always assured and the high frequency output is selected in linked relation to the selection of the cooking menu or manually.

It is another object of the present invention to provide an output selection switch, which is simple in structure, compact and inexpensive and which is adapted to select an optimum high frequency output for a selected cooking menu.

It is a further object of the present invention to provide a high frequency output selection switch having an indicator for indicating the selection of the high frequency output.

The above and other objects, features and advantages of the invention will become more apparent from the following detailed description of the preferred embodiments of the present invention when taken in conjunction with the accompanying drawings, in which.

Figure 1:
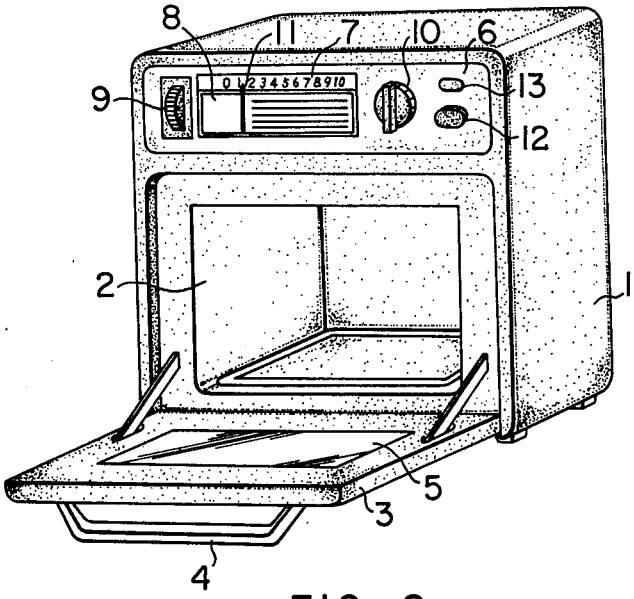
FIG. 1 is a perspective view of a microwave oven in accordance with the present invention with a door in its open position.
Figure 2:
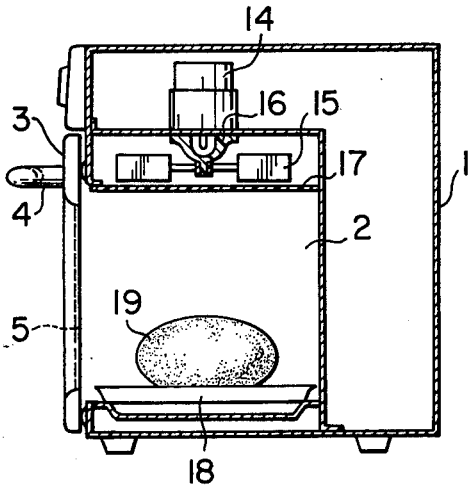
FIG. 2 is a longitudinal sectional view of the microwave oven.

A microwave oven is usually used to cook food by dielectric-heating making use of high frequency energy in the order of 2450 MHz. As shown in FIGS. 1 and 2, it comprises an oven body 1 within which a heating cavity 2 is provided, and a door 3 mounted on the oven body 1 and removably closing a front opening of the heating cavity. The door 3 includes a door handle 4 for opening and closing the door 3 and a door screen 5 through which the inside of the heating cavity can be viewed. Formed on a control panel 6 which is provided on a front top of the oven body 1, at a position corresponding to a time scale plate 7 of a timer, is a scale 8 for setting a heating time which is optimum to the quantity of food and to the particular type of food. By turning a control knob 9, a type of food to be cooked is selected, and by turning a timer knob 10 to set a timer indicator needle 11 to the quantity of the selected type of food, optimum cooking can be attained. The reference number 12 designates a cooking button and 13 designates a cooking lamp which is turned on while the high frequency wave is being generated.

Mounted on the top of the heating cavity are a magnetron 14 for radiating high frequency energy into the heating cavity, a stirrer vane 15 rotated by the air used to cool the magnetron, for stirring the high frequency wave in the heating cavity, a stirrer shaft 16 for supporting the stirrer vane 15, a partitioning board 17 for separating the stirrer vane from the cooking cavity and a tray 18 for mounting an article 19 to be cooked.

The present invention will now be described in detail as incorporated in the microwave oven of the above structure.

Figure 3:
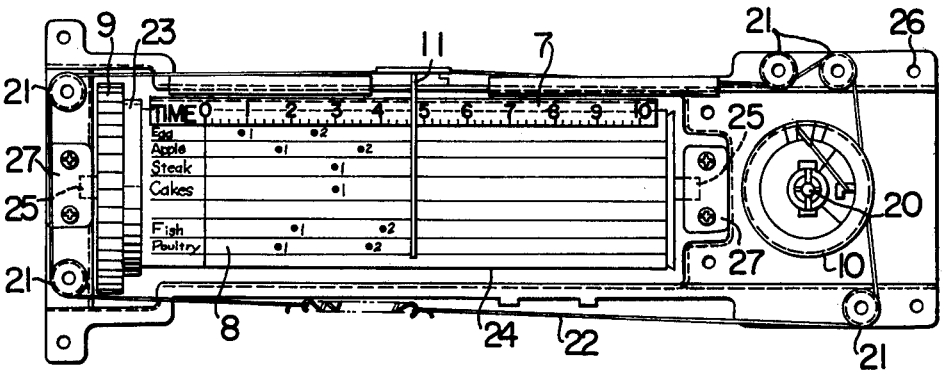
FIG. 3 is a front view, in an enlarged scale, of a cooking menu timer section.

Referring to FIG. 3, the reference numeral 20 designates a timer main shaft to which the timer knob 10 is fitted. As the timer knob 10 is rotated, a cord 22 linked to the timer shaft 20 is moved on a guide roller 21 so that the timer indicator needle 11 may be set to the time scale plate 7. By setting the indicator needle 11 to the quantity of food and for a particular type of food selected, an optimum heating time may be set. By turning the control knob 9 a cam 23 (FIG. 4) for selecting the high frequency output is rotated unitary with a rotary drum 24 to which the scale 8 for permitting the setting of an optimum heating time for the selected type and quantity of the food is adhered. A main shaft 25 of the drum 24 is supported by a bearing 27 fixed to a support 26. The pack timer unit is bolted to the control panel of the main body 1.

Figure 4:
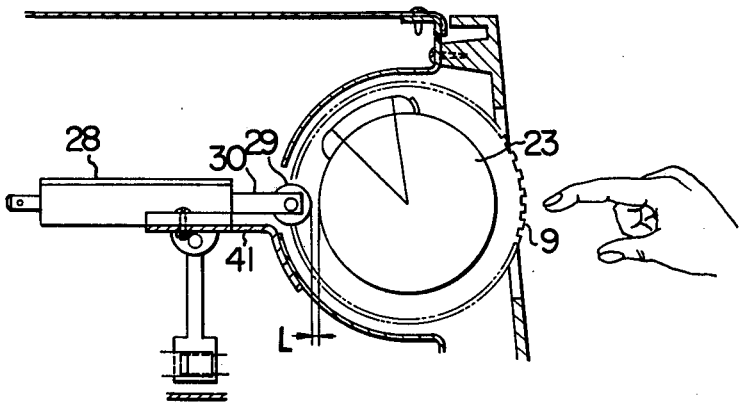
FIG. 4 is a sectional view showing a relation between the cooking menu timer and an output selection switch.

FIG. 4 shows a sectional view of a cam unit which switches the high frequency outputs when the high frequency outputs are to be selected in linked relationship with the selection of the cooking menu. By turning the control knob which is notched for facilitating rotation, the cam 23 for selecting the high frequency outputs is rotated so that a raised portion of the cam urges a main shaft 30 of the selection switch 28 (which shaft is provided with a roller 29 at its free end so that it may be pushed by a small force) to switch the selection switch 28 from its on position to its off position for switching the high frequency output from high state to low state.

Figure 5:
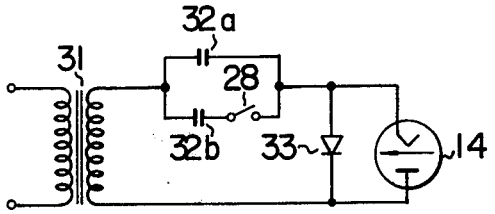
FIG. 5 is a circuit diagram of a high voltage power supply section of the microwave oven.

FIG. 5 shows an electrical circuit diagram of the microwave oven including the output selection switch, in which a half-wave voltage doubler rectifying circuit is usually used to supply a D.C. high voltage power to the magnetron 14. The reference numeral 31 designates a high voltage transformer and **32*a* and 32*b* designate capacitors connected in parallel therewith. The capacitor 32*b* is connected in series with the selection switch 28. The selection switch may be actuated manually rather than mechanically linked to the cam 23. The reference numeral 33 designates a diode and 14 designates the magnetron. In the figure, when the selection switch is in its on position, the resultant capacitance of the capacitors is large resulting in a high high-frequency output level, but when the selection switch 28** is in its off position the resultant capacitance decreases and the charge stored therein also decreases, resulting in a reduction in the high frequency output level.

By appropriately selecting the capacitances of the capacitors, it is possible to set the lower output level to 250 W or less.

Now the experimental evidence relating to the possibility of the growth of blowholes in the white of an egg in cooking the egg is explained.

The experiments proved that when the high frequency output was above 250 W blowholes grew in three trials or more out of ten trials, but when the high frequency output was 250 W or less, blowholes grew only once out of ten trials. This is considered to be due to the fact that when the high frequency output is above 250 W the difference between the temperature rise at the surface of the egg and the temperature rise inside the egg causes unbalance in the internal stress of the egg but when the high frequency output is 250 W or less a uniform temperature distribution is attained by thermal conduction, which serves to avoid the growth of blowholes. It has also been proved that the high frequency output of 250 W or less was advantageous to the defrosting of frozen food. It has thus become possible to effectively carry out egg cooking and defrosting which had been difficult with prior art microwave oven.

Discussing the selection switch 28, it is connected in series with the capacitor **32*b* in the voltage doubler rectifying circuit. When the selection switch 28 is in its off position, the voltage across the capacitor 32*a* is applied across the contact of the selection switch 28**. Therefore, it must be designed taking careful consideration of the insulation against high voltage. In the prior art device, a switch body was fixed such as by a bolt and the switch was turned on and off by means of separate control rod or an actuator mounted to the switch. In this case no problem occured where the switch was operated under 100–200 volts, but when it was operated under a high voltage such as D.C. 4 kilovolts, the insulation distance between the charging section and the mounting could not be selected to be sufficiently large and the switch was actuated by two or more parts, which resulted in the increase of dimensional tolerances, requiring a larger operation step in the cam when the switch was actuated by the cam.

Figure 6:
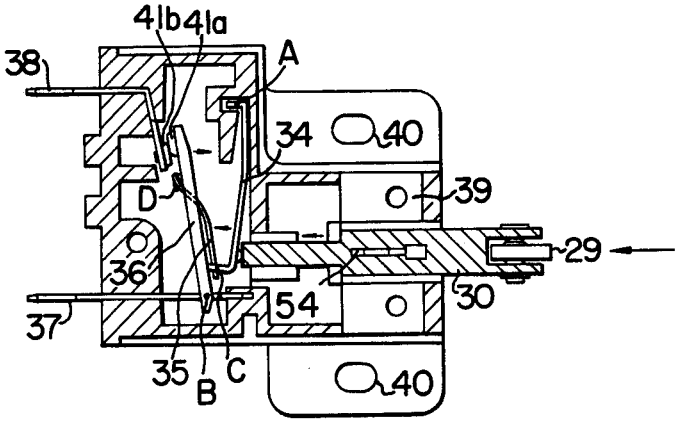
FIG. 6 is a longitudinal sectional view of a selection switch.

FIG. 6 shows a switch which is best suited for use under such conditions. In the figure, when the main shaft 30 having the roller 29 attached thereto is urged in the direction of the arrow, a receptacle 34 pivots around the point A to urge a contact spring 35. Then, a movable plate 36 pivots around the point B in the direction of the arrow to break the terminals 37 and 38. Since the switch is provided with a guide 39 of a control rod (main shaft) on a side of a switch casing made of an insulating material and the guide is formed with a fixing bore 40 for the body, the longer are the main shaft 30 and the guide 39, the longer may the distance between the switch mount 41 and the conducting portion of the switch 28 be selected.

As the switch of FIG. 6 is pushed in the direction of the arrow, the pressure applied between the contacts **41*a* and 41*b* decreases, and when the support point C for the receptacle 34 and the contact spring 35 goes beyond a straight line extending through the support point B and the support D for the contact spring 35 and the movable plate, the contact breaks. Thus, by leaving a clearance L (FIG. 4) between the roller 29 of the switch and the recessed portion of the cam, the recessed portion of the cam will not apply pressure force to the switch. This avoids the reduction of the contact pressure and ensures smooth rotation of the control knob 9**.

Figure 7:
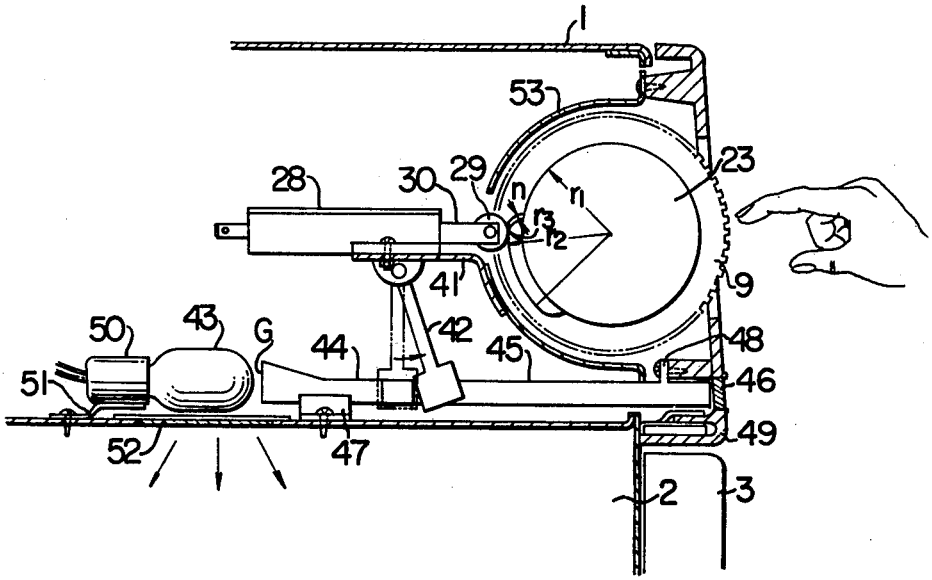
FIG. 7 is a sectional view illustrating the operational relationship between the cooking menu timer and the output selection switch.

The transition portion of the cam 23 from the recessed portion to the raised portion is now explained. Referring to FIG. 7, the cam 23 is formed with the step *n* at the area of $r_3$. The extent of the step corresponds to the area where all contacts of the switch 28 are turned on or off. The extent of the step also serves to cause the roller 29 to slip down into the area of $r_1$ when it is stopped adjacent to the $r_1$ area. The step may be provided on only one side as shown in FIG. 7 when the control knob 9 is perpendicular to a horizontal plane, because the roller 29 is prevented from slipping down toward the $r_1$ area even if it is stopped at the $r_3$ area by the action of gravity (the weight of the raised portion of the cam) when the non-stepped side is used. Where the cam 23 is mounted horizontally with respect to the ground, the steps should be formed on both $r_3$ areas of the cam.

A method for indicating the selection of the selecting switch on the control panel in linked relation to the selecting switch is now explained. In general, the control panel of the microwave oven is provided with various control parts such as a timer, cooking switch or the like and the space therefor should be as small as possible in order to make the overall dimensions of the oven as small as possible, where the switch for selecting the high frequency output is to be mounted in the menu timer as suggested by the present invention the available space is more and more limited making the mounting of a lamp for indicating the selection of the high frequency output difficult. The present invention provides an approach therefor. In accordance with the present invention, an optical path for an oven lamp is selectively interrupted by a shutter linked to the output selection switch to commonly use the oven lamp as an output indicator lamp to thereby provide an efficient utilization of the space in the control panel.

Figure 8:
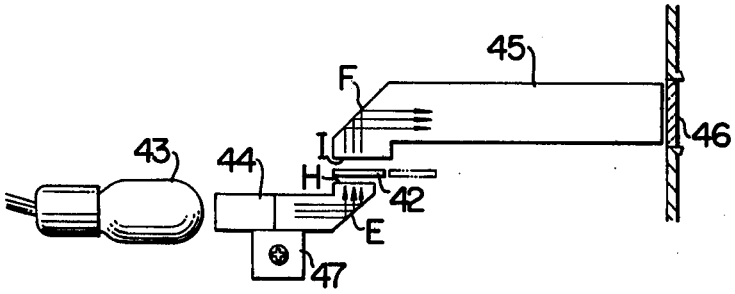
FIG. 8 illustrates the relationship between an output indicator section and a shutter linked to the output selection switch.

In the selection switch shown in FIG. 6, there is provided in guide member 39 attached to a side of the switch casing and the control rod 30 a bore 54 for permitting the movement of an end of a shutter 42 as shown in FIG. 7. Thus as the control rod 30 is moved, it is in the dash line position in FIG. 7 when the selection switch is in its on position but moved to the solid line position in the direction of the arrow when the selection switch is in its off position. Adjacent to a lamp 43 for illuminating the inside of the heating cavity 2, there is provided an optical guiding member 44, which cooperates with a second optical guiding member 45 interrupted by the shutter 42 to guide the light emitted from the lamp 43 to an indicator plate 46. In FIG. 8, when the selection switch is in its on position, the shutter 42 is in the solid line position so that the light from the lamp 43 reaches the optical guiding member 44 but interrupted by the shutter 42. As a result the light cannot reach the indicator plate 46. When the selection switch is in its off position, the shutter 42 is moved into the dashed line position so that the light is transmitted from the optical guiding member 44 to the optical guiding member 45 to illuminate the indicator plate 46.

By the inherent nature of the light, the light is reflected at right angle on a reflecting surface having an inclination angle of 45° (the surfaces E and F in FIG. 8) but the light does not enter the mounting legs 47 and 48 which are arranged in parallel to the optical guiding members, resulting in no loss of light.

Furthermore, in order to enhance the ability of light collection from a given light source, the area of a light receiving surface G of the optical guiding member 44 facing to the lamp is selected to be larger than the cross sectional area of the light conducting portion so that the lamp 43 and the optical guiding members can be mounted without necessiating the adjustment while maintaining the maximum performance even when the mounting positions thereof are slightly misaligned.

The optical guiding member 45 is bolted to the control panel 49 to bring the former into intimate contact with the indicator plate 46. The optical guiding member 44 is mounted on the same surface as that on which the lamp is mounted (an upper wall of the heating cavity in FIG. 7). Accordingly, the mounting positions for the optical guiding members 44 and 45 may be significantly misaligned. As an approach to overcome this inconvenience, the light receiving area of the optical guiding member 45 may be choosen to be greater than the area H of the optical guiding member 44 facing the shutter 42. In this manner they can be mounted without necessiating adjustment while preventing reduction in the light transmission ability.

In FIG. 7, the reference numeral 50 designates a lamp socket, 51 a socket mounting board, 52 a transparent resin film, and 53 a pack menu timer mounting board.

While the high frequency output is switched between the high level and low level in the above embodiment by the cam linked to the control knob 9 for selecting the cooking menu, it should be understood the output may be switched linearly in accordance with the cooking menu or it may be switched by any means other than the cam.

What is claimed is:

1. In a microwave oven including, an oven body having a heating cavity therein, a door for opening or closing a front opening of said heating cavity, a high frequency wave generating means for radiating high frequency energy into said heating cavity, a timer means for setting a heating time, and a cooking menu selecting means disposed on a front panel of said oven body including a rotatable scale having a plurality of menus printed thereon and a control know coupled to the rotatable scale for selecting one of said menus, the improvement comprising a high frequency wave output control means for controlling the magnitude of the output of said high frequency wave generating means, said high frequency output control means having a single switch operating rod being linked to a cam of said control knob of said cooking menu selecting means for effecting control of the output of said high frequency wave generating means in conjunction with the selection of a desired cooking menu, thereby generating an optimum high frequency wave output for the selected cooking menu.

2. A microwave oven according to claim 1 wherein said high frequency wave output control means controls the high frequency wave output to 250 watts or less for cooking eggs and defrosting frozen foods.

3. A microwave oven according to claim 2, wherein said high frequency wave output control means includes a switch means and a plurality of capacitors connected in a voltage doubler rectifying circuit in a power supply for said high frequency wave generating means, and wherein said switch means switches the resultant capacitance of said plurality of capacitors.

4. A microwave oven according to claim 3, wherein said control knob of said cooking menu selecting means is provided with a cam for actuating said switch means of said high frequency wave output control means.

5. A microwave oven according to claim 3, wherein said plurality of capacitors of said high frequency wave output control means comprises a parallel connection of at least two capacitors, the number of capacitors in said voltage doubler rectifying circuit being switched by said switch means to selectively provide a low or high output level from said high frequency wave generating means, said low output level being 250 watts or less and said high output level being in excess of 250 watts.

6. A microwave oven according to claim 5, wherein said switch means comprises a main shaft having a roller attached at one end and slidably supported by a guide formed on one side wall of a switch case, a movable plate having a contact on one end surface thereof and pivotably supported at the other end, said contact facing a further contact which is mounted on the switch case and connected to one terminal of said switch means, the other end of said movable plate being electrically connected to the other terminal of said switch means, a receptacle plate having one end pivotably fixed to the switch case and positioned between said movable plate and the other end of said main shaft, and a contact spring substantially S-shaped and having opposite ends supported by said movable plate and said receptacle plate respectively so that normally said contact of said movable plate is maintained in contact with said further contact on said switch case, wherein when said main shaft is displaced toward said receptacle plate due to a raised portion of said cam in accordance with the selection of a desired menu, the free end of said receptacle being moved pivotally to push said contact spring at the supported end thereof until the direction of the resilient force of said contact spring is reversed causing said contacts to open.

* * * * *